United States Patent [19]

Altnau

[11] 4,098,098

[45] Jul. 4, 1978

[54] OUT-OF-BALANCE AND SAFETY SWITCH ARRANGEMENT FOR WASHING MACHINE

[75] Inventor: Ronald L. Altnau, Ripon, Wis.

[73] Assignee: McGraw-Edison Company, Elgin, Ill.

[21] Appl. No.: 795,851

[22] Filed: May 11, 1977

[51] Int. Cl.[2] ..... D06F 37/42; F16P 3/10; H01H 3/16

[52] U.S. Cl. ..... 68/23 R; 192/136; 200/61.62; 210/144; 210/146

[58] Field of Search ..... 68/12 R, 23 R, 23.3; 210/144, 146; 192/136; 200/61.62

[56] References Cited

U.S. PATENT DOCUMENTS

| | | | |
|---|---|---|---|
| 2,882,360 | 4/1959 | Sisson | 200/61.62 X |
| 3,145,818 | 8/1964 | Stelli | 192/136 |
| 3,227,835 | 1/1966 | Conrath | 210/144 X |
| 3,504,777 | 4/1970 | Waugh | 68/23 R X |
| 3,763,670 | 10/1973 | Harrold | 68/12 R |

*Primary Examiner*—Philip R. Coe
*Attorney, Agent, or Firm*—Ronald J. LaPorte; Jon Carl Gealow; Charles F. Lind

[57] ABSTRACT

An out-of-balance and safety switch arrangement for a washing machine or the like device having a movable cover to control access to the clothes receiving tub, and wherein the tub is rotated rapidly to execute a centrifugal extraction cycle, includes a microswitch having an actuator normally biased to an extended position and depressible for energizing the drive motor for the tub and a switch actuator lever arm mounted adjacent the washing machine tub access cover for pivotal movement in first and second generally perpendicular planes with the lever arm being spring biased in the first plane for movement of the first end thereof into operative alignment with the switch actuator, the opposite end of the lever arm being positioned for engagement by the access cover upon closing the latter to move the first end of the lever arm in the second plane into engagement with the actuator for depression thereof. The opposite end of the lever arm is also located for engagement by the tub in response to predetermined excessive unbalanced rotation thereof whereby the lever arm is pivoted in the first plane against the biasing spring to release the actuator, the lever arm being biased back toward the extended actuator upon the discontinuation of the rotation of the tub, the first end of the lever arm engaging the side wall of the extended actuator and thereby being prevented from being operatively realigned therewith until the access cover is again opened.

8 Claims, 8 Drawing Figures

OUT-OF-BALANCE AND SAFETY SWITCH ARRANGEMENT FOR WASHING MACHINE

BACKGROUND OF THE INVENTION

This invention relates generally to clothes washing machines and the like devices which execute a centrifugal extraction cycle and more particularly to an improved out-of-balance and safety switch arrangement for such devices.

It is not uncommon in washing machines which include a centrifugal extraction cycle to exhibit a tendency to gyrate or vibrate excessively when the articles of clothing being centrifuged accumulate in one area of the washer tub or basket, thus unbalancing the tub. If this should occur, the out-of-balance rotating tub may strike and possibly damage the surrounding structure of the machine. To prevent the latter from occurring, switch arrangements which open the circuit to the tub drive motor in response to excessive unbalanced rotation of the tub have been provided. Many of these switch arrangements have been combined with a cover actuated switch which also opens the circuit upon opening the access cover to the washing machine tub and closing the circuit upon closing the tub access cover.

Examples of such switch arrangements are shown in U.S. Pat. Nos. 3,145,818; 3,227,835; and 3,504,777. While it appears that the switch arrangements of the last-mentioned patents will operate satisfactorily to prevent damage to a washing machine in the case of excessive gyration of the clothes tub as well as deactivate the washer drive motor to prevent injury to an operator opening the tub access cover during the operation of the washer, these arrangements appear for the most part to be rather complicated in design and as such would most likely be expensive to manufacture.

More specifically, the arrangement of the U.S. Pat. No. 3,145,818 employs tension and compression springs and a dual actuated switch to interrupt and complete the circuit to the washer drive motor. Furthermore, the arrangement requires a rubber or the like resilient knob mounted in an inner wall of the washer adjacent the tub for engagement by the tub when it is out of balance, to trigger certain linkages for deactivating the switch.

The construction of the arrangement of the U.S. Pat. No. 3,227,835 is also complicated, requiring a sliding plunger and a releasable catch mechanism which interact to provide the desired result.

The arrangement of the U.S. Pat. No. 3,504,777 also includes a large number of components, having a pair of springs which are stressed to move a latch and switch mechanism between two operating positions.

In addition to being costly and difficult to manufacture, it appears that there may be a tendency for the arrangements of the above-mentioned patents to become inoperative after a period of use because of the many interacting components employed therein.

SUMMARY OF THE INVENTION

Accordingly, it is a primary object of the present invention to provide a new and improved out-of-balance and safety switch arrangement which is similar in function to those described in the prior art, but which is considerably less complicated in design, having fewer components and is less expensive to fabricate.

It is another object of the present invention to provide an out-of-balance and safety switch of the last-mentioned type which mounts easily in a washing machine or the like centrifuging device and operates efficiently to prevent damage to the machine in the case of an unbalanced load.

Briefly, a preferred embodiment of the out-of-balance and safety switch arrangement according to the invention comprises a normally open switch device having a depressible actuator movable to a closed position and upon release returning to the normal open position and a switch actuator lever arm mounted on a bracket attached to the washing machine housing for pivotal movement in a first plane for movement of the first end of the lever arm into and out of alignment with the plunger, the lever arm being normally biased into alignment therewith and in a second plane substantially perpendicular to the first plane for movement of the first end of the lever arm into and out of operative engagement with the plunger for depressing and releasing such plunger. The opposite end of the switch actuator lever arm is positioned adjacent the rotating washer tub of the machine for engagement thereby upon the tub becoming excessively out of balance while being driven rotatably.

In operation, upon closing the access cover to the washer tub, subsequent to placing clothes to be washed therein, the cover engages the second end of the actuator switch lever arm, thereby pivoting the first end of the lever arm in the first plane into engagement with the switch actuator to complete a circuit to the washer drive motor. If during the washing operation, particularly the spin cycle, the washer tub should become excessively unbalanced, the side wall of the tub engages the second end of the lever arm sufficiently to pivot the lever arm about its axis in the second plane, moving the first end of the lever arm out of alignment with the switch actuator, thereby releasing the latter. In response thereto, the circuit to the washer tub drive motor is deenergized thereby discontinuing the rotation of the tub. Thereafter, the first end of the lever arm is moved in the second plane back toward the switch plunger. At this time, however, the switch actuator is in a released condition extending past the plane of rotation of the lever arm and as such engageable thereby only at the side wall of the actuator. To reoperate the switch the washer tub access cover must be raised, permitting the lever arm to be returned by the biasing force applied thereto into alignment with the switch actuator for reengagement of the plunger upon reclosing the access cover.

DETAILED DESCRIPTION OF THE DRAWINGS

Figure 1:
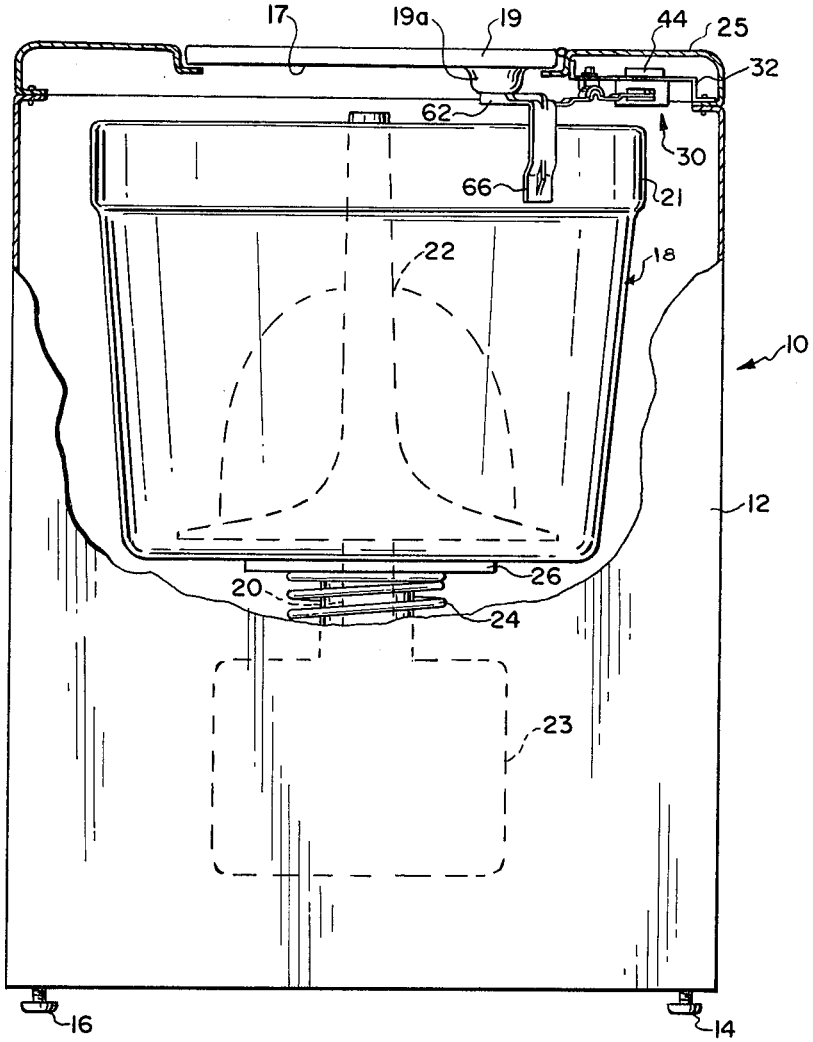
FIG. 1 is a partially broken away side view of a clothes washing machine including an out-of-balance and safety switch arrangement according to the invention.

Referring now to the drawings in greater detail wherein like numerals have been employed through the various views to designate similar components, there is illustrated in FIG. 1 a conventional clothes washing machine or the like device, generally designated by the numeral 10 including an outer housing 12 mounted on suitable legs 14, 16.

Within the outer housing is mounted a basket or tub 18 in which articles of clothing to be washed are placed. The tub 18 is rotatable on a vertical axis 20 and has about the periphery of its open top, an annular balance rim 21. A cover 19 is mounted on the top wall 25 of the washing machine housing for movement between open and closed positions to provide access to the clothes receiving tub 18.

The washing machine shown is illustrated as being of the vertical agitate type, in which the agitator 22 is arranged to be oscillated by a mechanism (not shown) provided in a transmission casing 23. The tub 18 is also rotated by means of such mechanism at a relatively high speed to effect the extraction of liquid from the clothes during a spin cycle. The tub is supported by suitable structure (not shown) which permits the tub to gyrate during the extraction operation. The gyration is resisted by the damping effect of a relatively heavy coil spring 24 that presses a disk 26 of friction material against the bottom wall of the tub. Any suitable drive motor (not shown) is arranged to power the washing and centrifuging operations. The tub support and drive mechanism for the washing machine illustrated are well known in the art and form no part of the present invention.

If, during the washing operation, the clothes being washed accumulate in one area of the tub, the tub may, during the extraction cycle, oscillate or wobble in an unbalanced manner beyond the capability of the damping spring 24 to stabilize the tub. At such time, it becomes necessary that the tub rotation be slowed or discontinued otherwise damage to the machine structure may occur. Also, even if no unbalanced rotation of the tub occurs, should the access cover 19 be opened during the centrifuging or other operation, it again becomes necessary to slow down or stop the tub rotation to insure the safety of the operator. The out-of-balance and safety switch arrangement 30 according to the invention has been provided in the washing machine 10 to carry out the latter functions.

Figure 2:
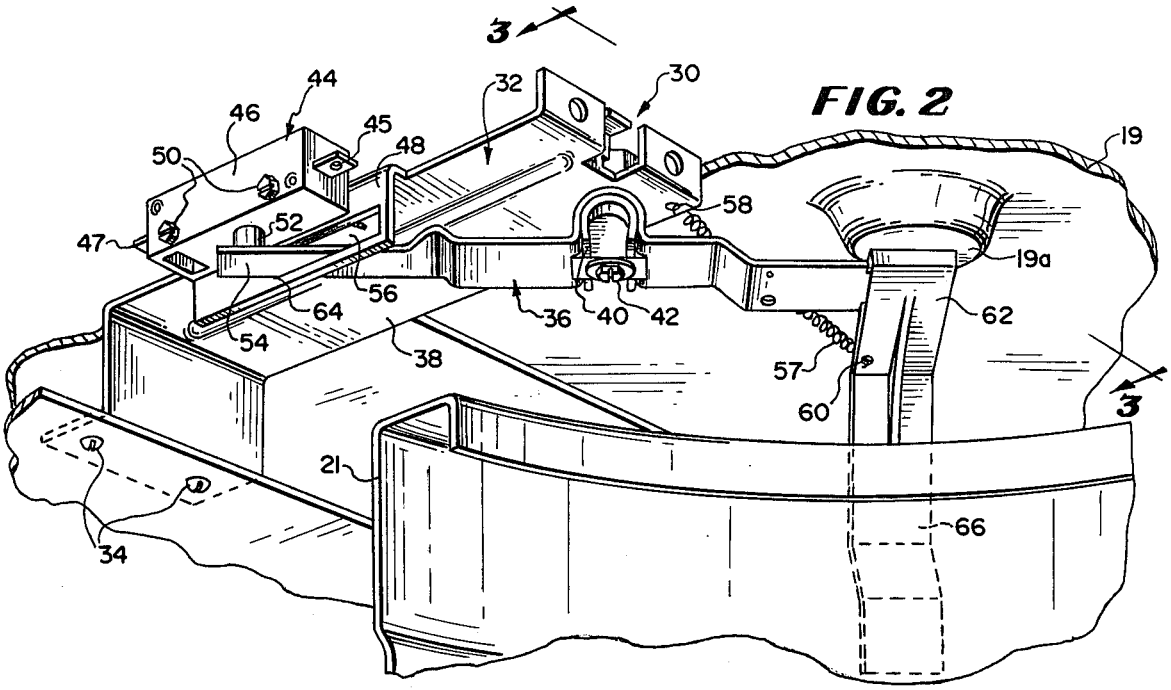
FIG. 2 is an enlarged fragmentary perspective view of the washing machine and out-of-balance and safety switch arrangement of FIG. 1, shown in a first operative condition.

Referring to FIGS. 2–8 of the drawings, the out-of-balance and safety switch arrangement 30 includes a mounting bracket 32 attached to the washing machine housing by means of suitable fasteners such as screws 34, see FIG. 2. The bracket is mounted adjacent the tub access cover 19. A switch actuator lever arm 36 is mounted on the lower wall 38 of the mounting bracket by means of a support member 40 of low friction material. A screw 42 extends through the support member and lever arm 36 into the bracket 32 to secure the former to the latter. The lever arm is curved at its center about the complementarily shaped support member for pivotal movement in a generally vertical plane. The lever arm is also pivotal with the support member 40 in a generally horizontal plane.

An electrical switch 44 having an outer casing 46 in which suitable contacts (not shown) are provided, is also attached to a downwardly extending portion 48 of the mounting bracket by means of suitable fasteners 50. The switch 44 includes also an actuator or plunger 52 of a predetermined length which is normally biased in an outwardly extending (vertically oriented) position and is depressible to a retracted position. The switch is of a conventional type commonly referred to as a microswitch. The operation of the switch plunger "makes" the switch contacts to complete the motor drive circuit for the washing machine. The switch is connected into the motor drive circuit at terminals 45, 47 thereof.

A first end 54 of the lever arm 36 extends through an opening 56 (FIGS. 2, 6 and 8) in the bracket portion 48 and is positioned normally against a stop taking the form of edge 64 defining one end of the opening 56 so that end 54 of the lever arm is operatively aligned with depressible plunger or actuator 52. A coil spring 57 is attached at one end 58 to the mounting bracket 32 and at the opposite end 60 to the opposite end 62 of the lever arm. The spring 57 biases the first end 54 of the lever arm in the horizontal plane against the edge 64 and in the vertical plane out of engagement with actuator 52 (see FIG. 8).

The opposite end 62 of the lever arm is located directly beneath an embossment **19*a* formed on the inner wall 17 of the tub access cover 19. The embossment 19*a* engages end 62 of lever arm 36 when the cover is moved to a closed position to in turn pivot the lever arm in the vertical plane against the force of spring 57 about support 40, moving end 54 of the lever arm into engagement with the actuator 52 and depressing the latter to operate switch 44**. The operation of the switch completes the energizing circuit to the tub drive motor.

An extension 66 of end 62 of the lever arm extends vertically downwardly adjacent the outer wall portion of the upper rim 21 of the tub 18. The lever arm extension 66 is positioned for engagement by the tub rim in the event the tub begins to rotate excessively out of balance, especially during the centrifuging cycle. In a preferred embodiment of the out-of-balance and safety switch arrangement according to the invention, the extension 62 of the lever arm is formed of a resilient plastic material and is received on the end 62 of the lever arm and is secured thereto.

Figure 3:
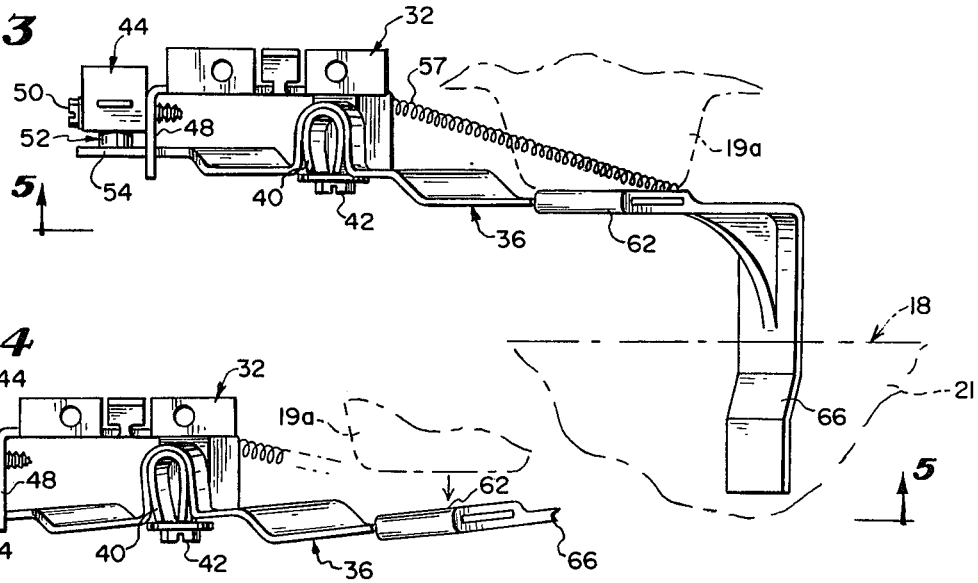
FIG. 3 is a sectional view of the out-of-balance and safety switch arrangement of FIG. 2 taken along the line 3—3.
Figure 4:
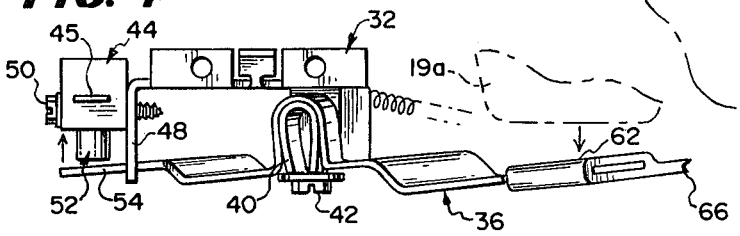
FIG. 4 is a side view of the out-of-balance and safety switch arrangement of FIG. 3 shown in a second operating condition.
Figure 5:
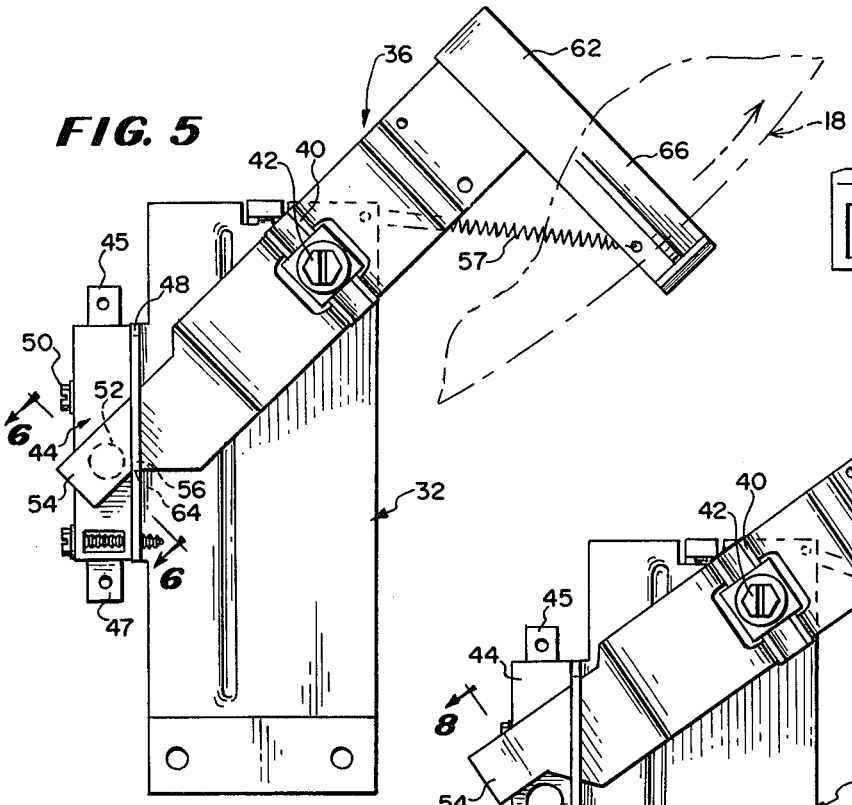
FIG. 5 is a plan view of the out-of-balance and safety switch arrangement of FIG. 4 shown in the first and second operating condition taken along the line 5—5.
Figure 6:
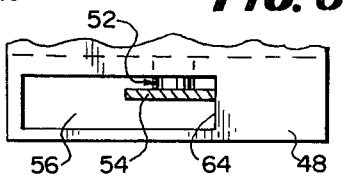
FIG. 6 is a sectional view of the switch and switch actuator lever arm of the out-of-balance and safety switch arrangement of FIG. 5 taken along the line 6—6.

In operation, subsequent to an operator placing clothes to be washed in the tub 18 along with washing powder or the like, he adjusts the washing machine controls (not shown) to program the washing machine through its cycles. Thereafter, the operator closes the access cover 19 (FIG. 4). Closing the cover causes embossment **19*a* on the lower wall 17 of the cover to engage end 62 of lever arm 36 of the out-of-balance and safety switch arrangement. Engagement of the lever arm end 62 pivots the lever arm in the vertical plane, moving end 54 of the arm into engagement with plunger actuator 52 (FIG. 3). Engagement of the actuator 52 by end 54 of the lever arm depresses the actuator 52 to operate the contacts of switch 44** to a closed condition, completing the circuit to the washing machine drive motor. Thereafter, the washing machine operation proceeds normally.

Figure 7:
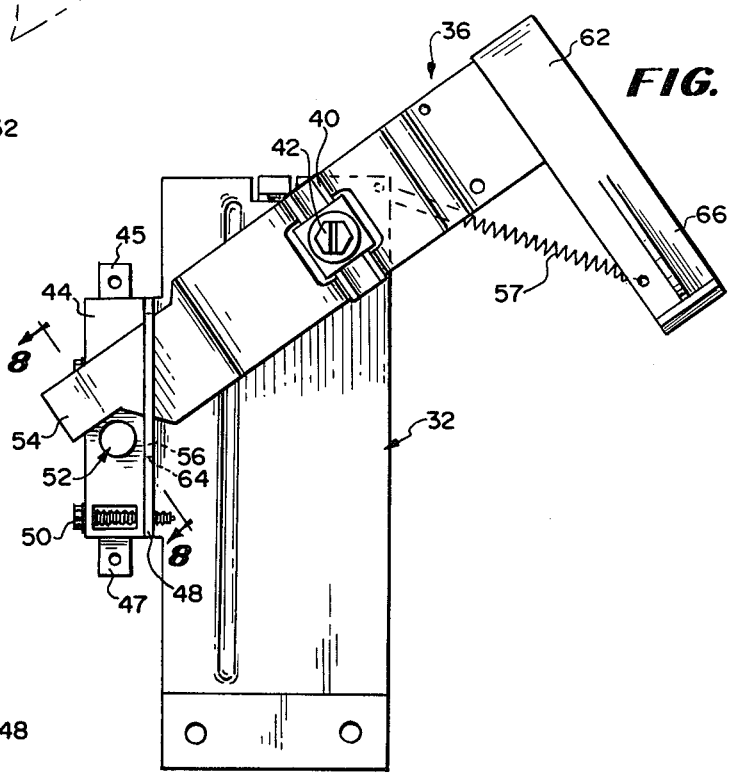
FIG. 7 is a plan view of the out-of-balance and safety switch arrangement of FIG. 5 shown in the third operating condition.
Figure 8:
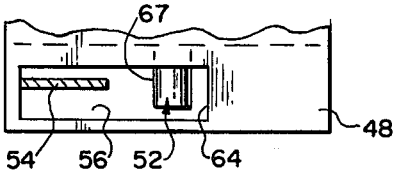
FIG. 8 is a sectional view of the switch and switch actuator lever arm of the out-of-balance and safety switch arrangement of FIG. 7 taken along the line 8—8.

Near the end of the rinse cycle during the operation of the machine, the machine is operated into a centrifuging operation whereby rinse water in the clothes is extracted by rapid rotation of the tub 18. In the event the clothes have become lodged in one area of the tub, unbalancing it excessively, the tub may begin to wobble and gyrate. Normally, the damping spring 24 provides sufficient force to prevent excessive gyration of the tub, but occasionally even the force of the spring is insufficient to overcome the out-of-balance gyrations. If the latter should occur, the top end of the tub will rotate outwardly from its normal position within the housing 12 and eventually engage extension 66 of end 62 of the lever arm. When this occurs, the lever arm 36 is pivoted in the horizontal plane against the force of spring 57, moving end 54 of the lever arm out of alignment with actuator 52 of the switch 44. To illustrate the latter, reference is made to FIGS. 5, 6 and 7, 8. When end 54 of the lever arm 36 is moved out of alignment with actuator 52, as shown in FIGS. 7 and 8, the plunger 52 is free to move to its extended position, opening the switch contacts in the circuit to the drive motor. Shortly thereafter, the rotation of tub 18 ceases or slows down to a point whereat lever arm 36 is rotated in the horizontal plane in the opposite direction by spring 57. Rotation of the lever arm as described, moves end 54 of the arm toward actuator plunger 52.

With the plunger in its extended position, end 54 of the lever arm is not able to become aligned again with the actuator for depression thereof (see FIG. 8). Consequently, the end 54 of lever arm 36 is urged into engagement with the side wall 67 of the plunger and remains in such position until the cover 19 is lifted to an open position. At such time, the lever arm is pivoted in the vertical plane. The biasing force of spring 57 also pivots lever arm 36 in the horizontal plane to realign end 54 of the lever arm with actuator 52, arranging the elements for operation of switch 44 upon reclosure of the access cover 19.

After the rotation of the tub has ceased and the cover 19 is open, the operator redistributes the clothes in the tub 18 and thereafter closes the cover 19 to continue the centrifuging operation.

As can be seen from the above description, the out-of-balance and safety switch arrangement according to the invention is a relatively simple but efficient device for discontinuing the operation of an unbalanced, gyrating washing machine or the like tub as well as a safety switch to prevent injury to an operator opening the washing machine access cover during the operation of the machine. The arrangement includes only three essential components; i.e. switch 44, lever arm 36 and biasing spring 57. As such, it can be expected that the out-of-balance and safety switch arrangement will operate efficiently over the life of the washing machine.

While a particular embodiment of the invention has been shown and described, it should be understood that the invention is not limited thereto since many modifications may be made. It is therefore contemplated to cover by the present application any and all such modifications as fall within the true spirit and scope of the appended claims.

I claim:

1. In a washing machine or the like device having a housing, a clothes receiving tub mounted for rotation in said housing, said tub mounting permitting out-of-balance rotation of said tub, means including a motor for rotating said tub, an energizing circuit for said motor, and a cover attached to said housing for movement between open and closed positions to control access to said tub, an out-of-balance and safety switch arrangement mounted on said washing machine housing, including in combination:

switch means operatively connected in said motor circuit, said switch means including an actuator biased to a first operating position and movable to a second operating position for controlling the energization of said motor, switch actuator lever arm means mounted for pivotal movement in first and second transverse planes, means biasing said lever arm means to a first position in said first plane for locating a first end of said lever arm means in operative alignment with said switch actuator, the opposite end of said lever arm means being positioned in the path of said tub access cover for engagement thereby upon moving said cover to a closed position, the first end of said lever arm means being pivoted in said second plane into engagement with said switch actuator for movement thereof from said first to said second operating position in response to the closing of said cover, whereby said motor circuit is completed for energization of said tub drive motor, a portion of the second end of said lever arm means being positioned adjacent said washing machine tub for engagement thereby in response to predetermined excessive unbalanced rotation of said tub, said lever arm means being pivoted in said first plane against said biasing means to a second position in response to engagement by said tub so that the first end of said lever arm means releases said switch actuator for movement to said first operating position, deenergizing said motor circuit, said biasing means pivoting said lever arm means in said first plane toward said first position upon discontinuation of the rotation of said tub, said first end of said lever arm means being relocated in operative alignment with said switch actuator only after said tub access cover is moved to the open position.

2. An out-of-balance and safety switch arrangement as claimed in claim 1 wherein said switch actuator is biased to a first extended position and is movable to a second retracted position for controlling the energization of said drive motor, and wherein the side wall of said switch actuator is positioned for engagement by said first end of said lever arm means upon discontinuation of the rotation of said tub subsequent to the deenergization of said drive motor circuit, thereby to prevent movement of said first end of said lever arm means into operative alignment with said switch actuator prior to the movement of said access cover to the open position.

3. An out-of-balance and safety switch arrangement as claimed in claim 1 wherein said switch actuator is movable in a generally vertical plane in a first direction to said first operating position and in the opposite direction to said second operating position, and wherein said first and second transverse planes in which said lever arm means is pivotal are generally horizontal and vertical, respectively.

4. An out-of-balance and safety switch arrangement as claimed in claim 3 further including a bracket mounted within said washing machine housing adjacent said tub access cover, a support member securing said lever arm means to said bracket for pivotal movement in said first and second planes, and wherein said bracket includes a generally vertically extending portion to which said switch means is attached, the bracket portion defining an opening through which said first end of said lever arm means extends, said bracket portion further including stop means, said first end of said lever arm means being biased into engagement with said stop means defining said opening for aligning said first end of said lever arm means with said switch actuator.

5. In a washing machine or the like device which executes a centrifuging cycle, having a housing, a clothes receiving tub mounted for rotation within said housing, means including a drive motor for rotating said tub and an energizing circuit for said motor and a cover attached to said housing for movement between open and closed positions to control access to said tub, an improved out-of-balance and safety switch arrangement mounted within said washing machine housing, including in combination:

a bracket mounted adjacent said tub access cover, switch means mounted on said bracket operatively connected in said motor circuit, said switch means including contact means operable to closed and open conditions for energizing and deenergizing said drive motor, respectively, and an actuator biased to a first outwardly extending position for operating said contact means to one of said open and closed conditions and depressable to a second retracted position for operating said contact means to the other of said open and closed conditions, an actuator lever arm mounted on said bracket for pivotal movement in first and second generally perpendicular planes, means biasing said lever arm to a first position in said first plane to locate a first end of said lever arm in operative alignment with said switch actuator, the opposite end of said lever arm being positioned in the path of said tub access cover for engagement thereby upon moving said cover to a closed position, said first end of said lever arm being pivoted in response thereto in said second plane into engagement with said switch actuator for operating said contact means to said one condition to energize said drive motor circuit, said opposite end of said lever arm also being positioned adjacent said tub for engagement thereby in response to predetermined excessive unbalanced rotation of said tub, especially during said centrifuging cycle, said lever arm being pivoted in said first plane against said biasing means in response to engagement by said tub so that said first end of said lever arm releases said switch actuator for movement to said first extended position, thereby deenergizing said drive motor circuit, the first end of said lever arm being pivoted by said biasing means toward said switch actuator in response to the discontinuation of rotation of said tub, said first end of said lever arm engaging said extended switch actuator until said tub access cover is moved to the open position, whereby said lever arm is pivoted for relocation of said first end of said lever arm into operative alignment with said switch actuator.

6. An out-of-balance and safety switch arrangement as claimed in claim 5 wherein said bracket includes predeterminedly located stop means, the first end of said lever arm normally being biased into engagement with said stop means for aligning said last-mentioned end of said lever arm with said switch actuator.

7. An out-of-balance and safety switch arrangement as claimed in claim 6 wherein said bracket includes a portion on which said switch means is mounted, said portion defining an opening through which the first end of said lever arm extends, a first edge of said bracket portion adjacent said opening forming said stop means for engaging said first end of said lever arm thereby to align the latter with said switch actuator.

8. An out-of-balance and safety switch arrangement as claimed in claim 7 wherein the first and second generally perpendicular planes in which said lever arm is pivotal are substantially horizontal and vertical, respectively, wherein said bracket portion extends vertically downwardly and wherein said switch actuator is movable in a generally vertical direction.

* * * * *